United States Patent [19]

Vork

[11] 4,147,478

[45] Apr. 3, 1979

[54] SECONDARY PUMP FEED APPARATUS

[75] Inventor: William D. Vork, Edina, Minn.

[73] Assignee: Graco Inc., Minneapolis, Minn.

[21] Appl. No.: 835,686

[22] Filed: Sep. 22, 1977

[51] Int. Cl.[2] ..... F04B 21/02

[52] U.S. Cl. ..... 417/458; 417/503

[58] Field of Search ..... 417/503, 458, 441, 568; 138/45

[56] References Cited

U.S. PATENT DOCUMENTS

| | | | |
|---|---|---|---|
| 1,277,383 | 9/1918 | Cherry | 417/503 |
| 2,266,125 | 12/1941 | Malsbary | 417/503 |
| 2,604,854 | 7/1952 | Taylor | 417/441 |
| 2,632,476 | 3/1953 | Miller | 138/45 |
| 2,819,678 | 1/1958 | Nordell | 417/571 |
| 2,971,470 | 2/1961 | Wein et al. | 417/568 |
| 3,042,981 | 7/1962 | Dilone | 417/503 |
| 3,205,830 | 9/1965 | Clack | 417/568 |
| 3,601,510 | 8/1971 | Sadler | 417/503 |

FOREIGN PATENT DOCUMENTS

| | | | |
|---|---|---|---|
| 2306406 | 8/1974 | Fed. Rep. of Germany | 417/503 |
| 2613702 | 10/1977 | Fed. Rep. of Germany | 417/503 |

*Primary Examiner*—William L. Freeh

*Attorney, Agent, or Firm*—Paul L. Sjoquist

[57] ABSTRACT

Apparatus for connecting to a pump inlet where a first inlet feedpipe is attached including a second inlet feedpipe tap having a one-way check valve, and a resilient orifice member in the first inlet feedpipe upstream of the tap, whereby the orifice size is less than the inlet feedpipe size so as to provide a flow restriction for periodically creating negative pressure in the region of the tap, to draw liquid from the second inlet feedpipe into the first inlet feedpipe.

4 Claims, 2 Drawing Figures

SECONDARY PUMP FEED APPARATUS

BACKGROUND OF THE INVENTION

This invention relates generally to liquid pumps and apparatus for permitting the addition of a secondary liquid to the primary pump liquid at the pump inlet. The invention relates specifically to positive displacement pumps such as piston or diaphragm pumps wherein a reciprocating member creates variable liquid pressure impulses and thereby accepts primary liquid at its inlet under varying flow rate conditions.

U.S. Pat. No. 2,389,134, issued Nov. 20, 1945, discloses a simple fluid flow control device by means of which a constant rate of fluid flow through the device is secured, irrespective of the pressure variation of the fluid delivered to the flow control device. The device comprises a flexible member having an opening therethrough which is smaller in cross-sectional area than a fluid flow passage into which the device is inserted. The device typically rests upon an internal shoulder in the fluid flow passage, which shoulder provides a partial supporting structure for the flexible member, although the opening through the member is always smaller than the opening created by the projecting shoulder. When fluid is passed through the passage in which this device is supported the pressure of the fluid upon the upstream face of the flexible member causes the member to become distorted in a downstream direction, thereby reducing the cross-sectional area of the member opening exposed to the fluid flow. This reduction in opening causes a corresponding increase in pressure drop to ensure a relatively constant liquid flow rate through the device, and the device operates on the principal that its interior opening is inversely proportional to the liquid pressure sensed by the device to thereby maintain a constant liquid flow rate therethrough.

U.S. Pat. No. 2,454,929, issued Nov. 30, 1948, disclosed an improvement over the foregoing device by constructing the passage immediately downstream of the flexible member into a conically shaped seat to permit greater deflection of the member for improved liquid flow control. U.S. Pat. No. 2,899,979, issued Aug. 18, 1959, disclosed a further improvement over the foregoing invention by incorporating a supporting metal ring into the flexible member to control the flexible member distortion and thereby enable the use of the device over higher liquid pressure and volume ranges.

Other inventions have further modified and improved the basic flow control device, but in its essential attributes it provides liquid flow rate control utilizing the principal of a flexible member having a deformable passage of cross-sectional area which is inversely proportional to the liquid pressure on the member. In the present invention this principle is combined with a secondary liquid feedpipe placed downstream of the flexible device, both of which are placed at or near the inlet port of a reciprocating pump. The action of the combined members in response to the normal pressure fluctuations caused by the reciprocating pump creates a region of low or negative pressure downstream of the flexible member for drawing secondary fluid flow into the primary fluid flow passage.

It is well known that a positive displacement pump of the reciprocating type, particularly a diaphragm or piston pump, has an undulating flow rate both at the intake port and the discharge port. This undulating flow rate is caused by the generally sinusoidal flow characteristics of the pump, wherein flow starts at zero at the pump dwell point, rising to maximum flow at the midpoint of the intake stroke and falling back to zero at the second pump dwell point. It is generally understood that the peak flow rate during the pump intake cycle and during the pump discharge cycle is considerably greater than the average flow rate during the complete cycle. In other words, a pump which is rated at two gallons per minute discharge flow rate will intake liquid at a peak rate of about three gallons per minute during the intake stroke and similarly discharge at a peak rate of about three gallons per minute on the discharge stroke. This undulating flow is generally smoothed out by some type of surge suppressor on the inlet and outlet side of a reciprocating pump. However, a surge suppressor typically only reduces, without eliminating, fluctuations in liquid flow rate during pump operating.

The present invention provides a simple and inexpensive apparatus for introducing a liquid additive into a primary flow liquid for pumping and mixing. For example, it provides an apparatus for introducing liquid soap into a water passage wherein the mixture is drawn into a reciprocating pump and pressurized for cleaning purposes. In the prior art liquid additives which were handled in this manner required a pressure regulator on the pump intake line to control the inlet pressure, or a line restriction of some sort to control the total flow through the pump inlet. This has the disadvantage of being extremely difficult to balance to provide the proper pressure without introducing pump cavitation. The present invention overcomes this disadvantage by causing a negative pressure during only a small portion of the pump intake stroke, which negative pressure may be controlled as to time and magnitude so as to control the amount of additive introduced as well as to permit enough positive pressure on the remaining pump intake stroke to prevent cavitation.

This invention relates generally to positive displacement pumps which develop periodic flow surges through their normal operating cycles. It is particularly adapted for use with a diaphragm pump of the type generally disclosed in U.S. application Ser. No. 701,807, filed July 7, 1976 and owned by the same assignee as the present invention.

SUMMARY OF THE INVENTION

The present invention comprises a pump inlet connection having a resilient orifice member and an inlet tap located between the orifice member and the pump inlet, wherein the inlet tap comprises a one-way check valve which permits fluid flow from the tap into the pump inlet, and wherein the flexible orifice member is sized to accommodate an unrestricted flow rate at least equal to the average pump flow rate capability but less than the peak pump flow rate capability.

BRIEF DESCRIPTION OF THE DRAWINGS

A preferred embodiment of the present invention is disclosed hereinafter, and with reference to the appended drawings, in which.

DESCRIPTION OF THE PREFERRED EMBODIMENT

Figure 1:
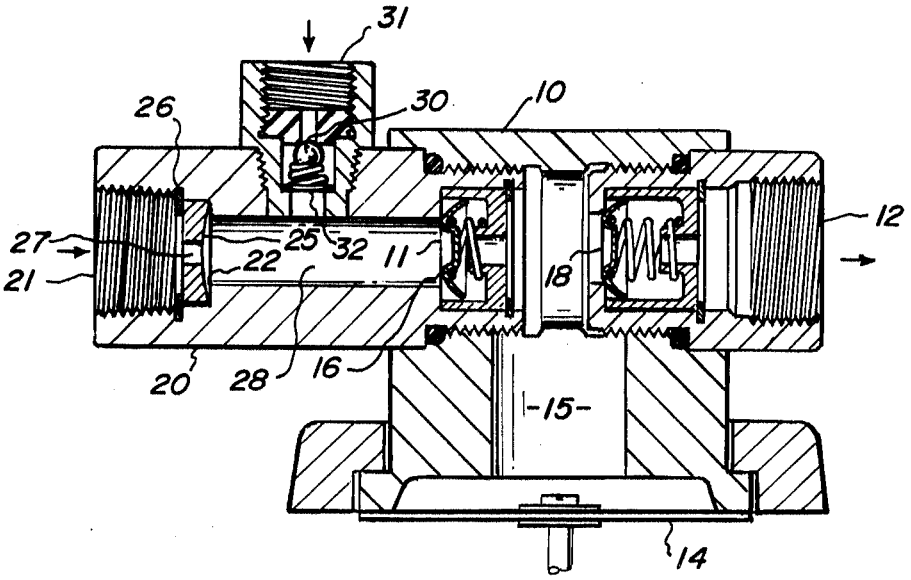
FIG. 1 shows the invention in cross section attached to a pump inlet.

Referring first to FIG. 1, the invention is shown in cross section attached to a diaphragm pump 10, which has an inlet 11 and an outlet 12. Pump 10 operates according to conventional pumping principles wherein liquid is drawn into inlet 11 during an intake pump stroke, where it accumulates in a chamber 15, and is expelled from the pump through outlet 12 during an exhaust pump stroke. Diaphragm 14 is a reciprocating member which creates the necessary inlet and outlet pressure forces, although other types of reciprocating positive displacement pumps are equally well adapted to the present invention. A spring-loaded inlet check valve 16 deflects during the pump intake stroke to admit liquid into chamber 15. A similar spring-loaded outlet check valve 18 is deflected during the pump exhaust stroke to permit fluid to escape from chamber 15 through outlet 12.

A threaded housing 20 is attached to pump inlet 11. Housing 20 has a threaded inlet 21 for accepting a source of pressurized liquid. Typically, inlet 21 is threaded to accept a hose connection from a water supply such as is available in residential homes and industrial plants. Water supplies of this general category are pressurized in the range of 15 pounds per square inch (psi) to 75 psi. A shoulder 22 is provided in housing 20 for seating a resilient orifice member 25, made from rubber or plastic material. Orifice member 25 has a central pasage therethrough which is of a smaller diameter than the internal passage in housing 20, and may be retained within housing 20 by means of a retainer ring 26. Orifice member 25 is designed to deflect inwardly toward the pump inlet and thereby reduce the cross section area of its passage 27 in response to increases in pressure at inlet 21, thereby maintaining a relatively constant flow rate therethrough. However, as the pressure drop across orifice member 25 increases a relatively more negative pressure develops in housing passage 28, which negative pressure is utilized to activate the secondary feed inlet 31.

Secondary inlet 31 is threadably attached to housing 20, and has a spring-loaded ball check valve 30 seated at its base. Ball check 30 is held against its seat by means of compression spring 32, and reverse flow through secondary inlet 31 is thereby prevented. Inlet 31 is preferably connected to a source of secondary liquid, such as chemical or soap additive, which is maintained at an atmospheric pressure. Whenever the pressure in housing passage 28 drops below atmospheric pressure by a predetermined amount, ball check 30 becomes unseated and liquid flows into housing 28 via secondary inlet 31. The direction of liquid flow with respect to the inlets and outlets described herein is shown by means of arrows on FIG. 1.

Figure 2:
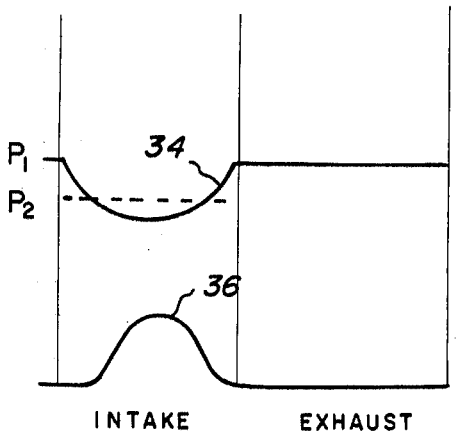
FIG. 2 is a graph showing pressure and flow rate during the pump stroke cycle.

FIG. 2 illustrates graphically the pressure and flow rate conditions which exist within housing passage 28. Curve 34 shows the typical pressure variation within housing passage 28 during the pump intake and exhaust strokes. During the exhaust stroke the intake liquid pressure is denoted as $P_1$, which is equal to the liquid pressure in the lines connected to inlet 21. During the intake stroke liquid is drawn into pump chamber 15 at a relatively constant flow rate, as controlled by orifice member 25, but the peak flow demand of pump 10 exceeds the flow rate permitted by orifice member 25, thereby creating a negative pressure in passage 28. This negative pressure drops below the pressure at secondary inlet 31 and causes ball check 30 to become unseated, thereby permitting secondary liquid flow into passage 28. This secondary liquid flow is shown by curve 36, and it is to be noted that such flow occurs only during the portion of the pump intake stroke wherein the pressure in passage 28 is more negative than the pressure at secondary inlet 31. The net effect of this controlled secondary inlet flow is to provide a metered volume of secondary fluid into each intake pump stroke, which secondary fluid is invariably mixed with the primary fluid (water) admitted through inlet 21.

In operation, if the pump is rated at an average flow rate of two gallons per minute it will have a peak flow rate in excess of three gallons per minute during a portion of its pumping cycle. Resilient orifice member 25 is therefore selected to permit unrestricted flow at the rate of two gallons per minute but tends to restrict flow rates above that volume. This means that the negative pressure in passage 28 will develop during a portion of each intake stroke as illustrated in FIG. 2, and a small amount of secondary liquid will be injected into the primary liquid during that portion of the intake stroke.

If the invention is used in conjunction with a pump adapted for high pressure cleaning, the secondary inlet 31 may be coupled to a source of liquid cleaning fluid such as soap. This fluid will become injected into the water supply provided by the pump in metered quantities as described herein, and the system will therfore deliver a pressurized, soapy water solution.

The apparatus therefore provides a very simple and inexpensive device for metering small quantities of a secondary liquid such as soap into a primary liquid which is to be pressurized and delivered. The inherent pumping action of pump 10 will cause the two liquids to become thoroughly mixed during the pumping process. The invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for connecting to a positive displacement pump for providing the metered introduction of a secondary liquid to the primary liquid delivered by the pump, comprising:

(a) a housing for permitting primary liquid flow therethrough, said housing having an internal shoulder and a downstream passage of reduced diameter;

(b) a resilient member seated on said shoulder, said resilient member having an orifice therethrough of lesser size than said housing downstream passage and further sized to restrict fluid flow therethrough to a lesser quantity than the peak pump flow delivery rate; and (c) a secondary inlet in said housing downstream of said resilient member, said secondary inlet having a one-way check valve therein to permit liquid flow toward said housing and to restrict reverse liquid flow.

2. The apparatus of claim 1, wherein said secondary inlet further comprises means for spring biasing said one-way check valve toward a closed position.

3. The apparatus of claim 1, wherein said housing further comprises a threaded inlet for accepting a water supply hose.

4. The apparatus of claim 3, wherein said secondary inlet further comprises a threaded member for accepting a soap supply tube.

* * * * *